US006012569A

United States Patent [19]

Sorrentino

[11] Patent Number: 6,012,569

[45] Date of Patent: Jan. 11, 2000

[54] TOOTHBRUSH MANUFACTURING HANDLING DEVICE

[75] Inventor: Alan V. Sorrentino, Cranbury, N.J.

[73] Assignee: Colgate-Palmolive Company, New York, N.Y.

[21] Appl. No.: 09/083,014

[22] Filed: May 21, 1998

[51] Int. Cl.[7] ..... B65G 37/00

[52] U.S. Cl. ..... 198/867.11; 29/33 P

[58] Field of Search ..... 198/867.11, 867.06, 198/465.2; 29/33 P

[56] References Cited

U.S. PATENT DOCUMENTS

| | | | |
|---|---|---|---|
| 3,090,478 | 5/1963 | Stanley . | |
| 3,135,375 | 6/1964 | Henn et al. | 198/867.11 |
| 3,650,373 | 3/1972 | Kern et al. . | |
| 3,811,548 | 5/1974 | Neff . | |
| 3,907,125 | 9/1975 | Seckinger . | |
| 4,029,961 | 6/1977 | Lohr et al. | 198/465.2 |
| 4,040,533 | 8/1977 | De Boer et al. . | |
| 4,305,496 | 12/1981 | Hoppmann et al. . | |
| 4,552,260 | 11/1985 | Teagno et al. . | |
| 4,635,662 | 1/1987 | Trotten | 198/867.11 |
| 4,694,950 | 9/1987 | Macleod . | |
| 4,736,830 | 4/1988 | Hofmann . | |
| 5,535,875 | 7/1996 | Russell | 198/867.06 |
| 5,926,941 | 7/1999 | Neri et al. | 198/867.11 |

*Primary Examiner*—Jospeh E. Valenza
*Attorney, Agent, or Firm*—Henry S. Goldfine; Richard J. Ancel

[57] ABSTRACT

A toothbrush handling device for handling of toothbrushes during the manufacturing process. The device is a rigid toothbrush holder with fixed dimensions which is easily transported in a conveyor type apparatus. The holder is formed with a generally toothbrush-shaped portion and terminates in at least one cavity suitable to hold at least the head portion of the toothbrush such that the bristles do not contact any interior surface of the cavity. If only one cavity is present, it is large enough to permit a gripping mechanism to grasp a portion of the brush to permit the insertion of the brush into or the removal of the brush from the transport device. Also, if more than one cavity is present, the cavities are separated by a supporting wall. The device enables improved and easier handling of the toothbrushes during manufacturing and processing, and protects the bristles from damage during those processes.

21 Claims, 5 Drawing Sheets

TOOTHBRUSH MANUFACTURING HANDLING DEVICE

BACKGROUND OF THE INVENTION

This invention relates to the field of brush manufacture; specifically, to the manufacture of toothbrushes in an automated assembly/processing facility. Toothbrushes must be handled carefully during processing and manufacture for several reasons. First, the bristles are especially delicate. Also, it is desired to result in a final product which is as flawless as possible, since a flawless surface results in a brush which is more attractive and of a higher value.

DESCRIPTION OF THE PRIOR ART

The related arts have recognized the usefulness of a carrier in an automated assembly line. U.S. Pat. No. 3,090,478 describes a container carrier adaptable for receiving containers or bottles of various sizes. This is said to avoid the necessity of retooling a production line for different sizes. U.S. Pat. No. 4,552,260 discloses a series of pallets on a guide extending past workstations.

U.S. Pat. No. 4,040,533 discloses multiple test sample transport means which holds a plurality of test tube type sample holders in a rectangular shaped containers.

U.S. Pat. Nos. 3,650,373 and 3,811,548 disclose work holders on conveyors, while U.S. Pat. No. 4,305,496 discloses a method of transporting parts by dropping them into containers or "pucks" on a centrifugal feeder.

U.S. Pat. No. 4,694,950 discloses an open bottomed tray for supporting articles while they are being worked on from below.

U.S. Pat. No. 4,736,830 discloses transport plates for a low-noise low-shock operation. The plates may be polygonal, and have elements which fit within positioning recesses to lock them into position. U.S. Pat. No. 4,739,607 discloses a pallet feeding conveyor which places a pallet under a piece to be worked upon, then removes it and returns it to the beginning of a conveyor for use under another piece to be worked.

SUMMARY OF THE INVENTION

A novel rigid toothbrush holder with uniform dimensions that can be transported on a conveyor system has been developed by the inventor disclosed herein. The holder is formed with precise geometric dimensions so that it may be stacked, aligned, and grouped in lines for easy feeding, loading, stacking, or processing steps.

The invention is best understood by reference to the drawings.

DETAILED DESCRIPTION

The device is formed of a solid body material such as high impact plastic, aluminum, steel, or any other durable substance which will withstand the rigors of industrial handling.

Figure 1A:
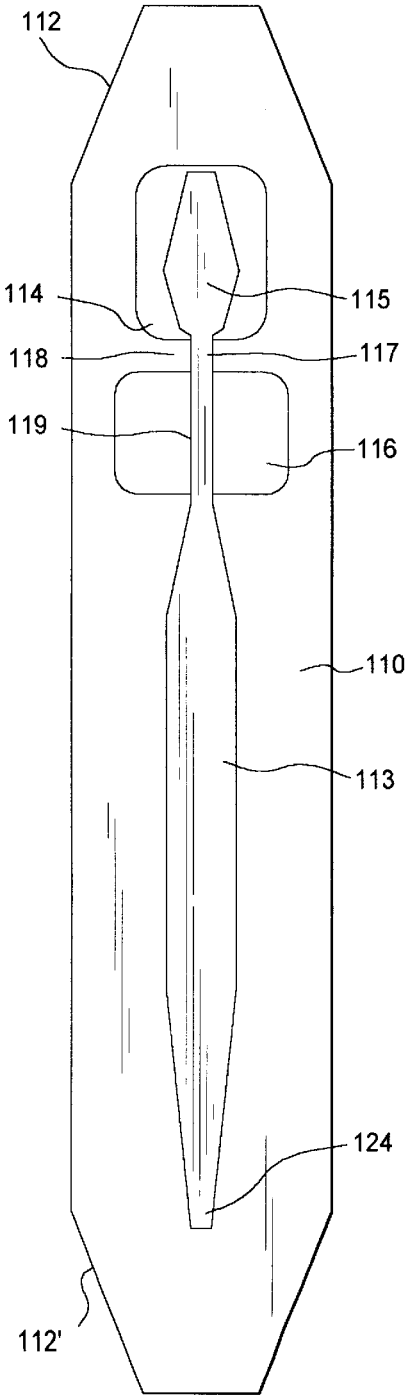
FIG. 1A is a top plan view of a first embodiment of a transport device according to the present invention.
Figure 1B:
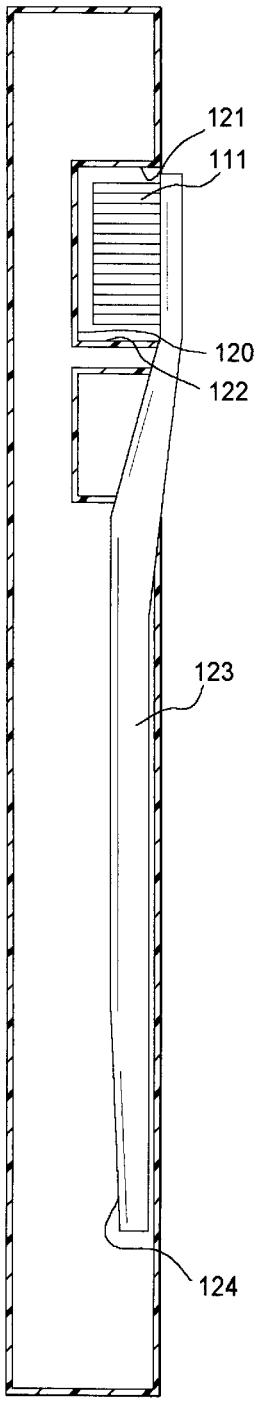
FIG. 1B is a view in side elevation of a first variation of a transport device according to FIG. 1A.
Figure 1C:
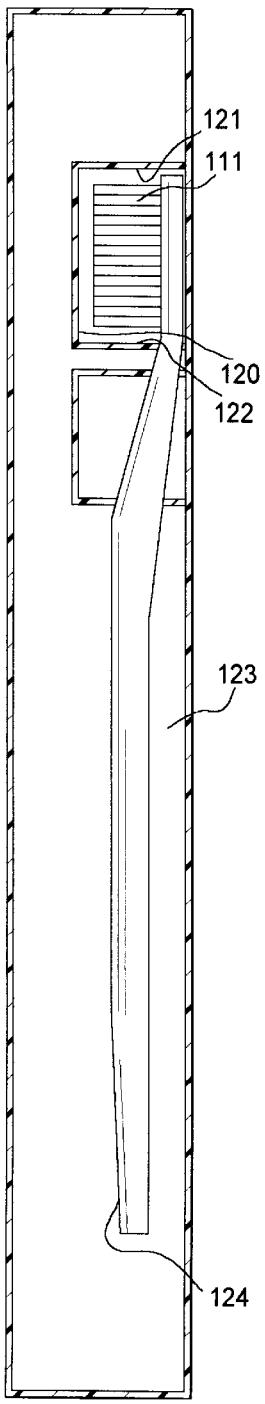
FIG. 1C is a view in side elevation of a second variation of a transport device according to FIG. 1A.

The body 110 as shown in FIG. 1 is generally rectangular, and a preferred embodiment contains rounded or tapered ends 112 and 112' which enable easier alignment and feeding in chutes, conveyors, and by spindles. Elongated toothbrush 113, having a head portion 115, bristles 111 affixed to one surface of said head portion, neck portion 117, and handle portion 123 is shown in FIG. 1B in outline and resting partly in a generally brush-shaped recess 124 within body 110. In. FIG. 1C, handle portion 123 is shown in outline and resting wholly in generally brush-shaped recess 124 within body 110.

Recess 124 includes a first cavity 114 at the end of the body 110 that will hold brush head 115. In use, this combination of recess 124 and first cavity 114 maintains the bristles 113 of the brush (bristles are underneath head 115, not visible in FIG. 1A) free from contact with any of the interior surfaces of the cavity 114.

Figure 3A:
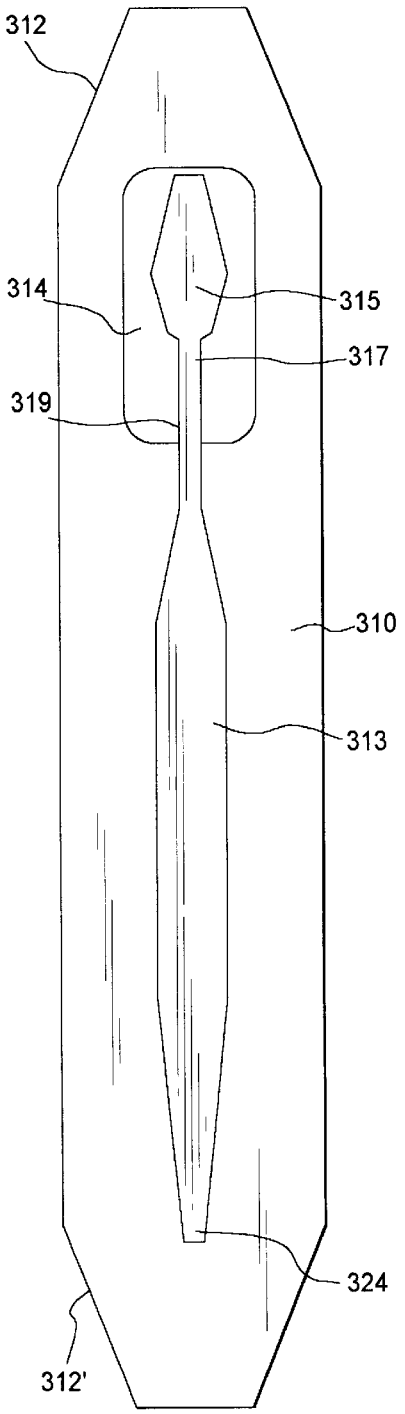
FIG. 3A is a top plan view of a third embodiment of a transport device according to the present.
Figure 3B:
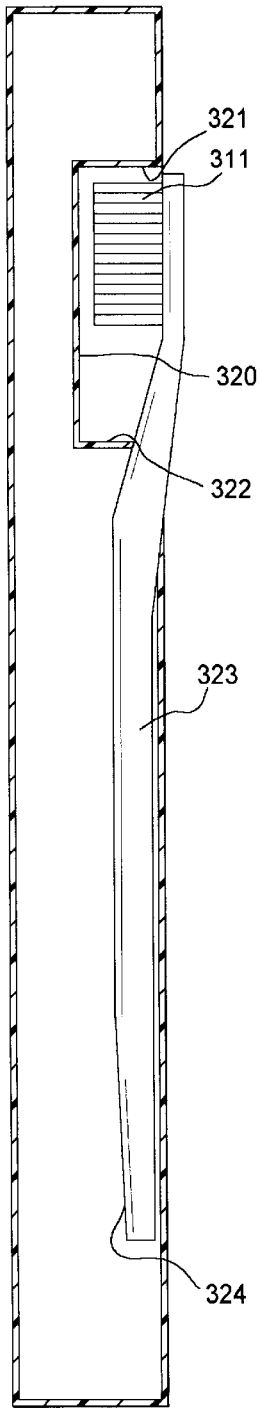
FIG. 3B is a view in side elevation of a first variation of the transport device according to FIG. 3A.
Figure 3C:
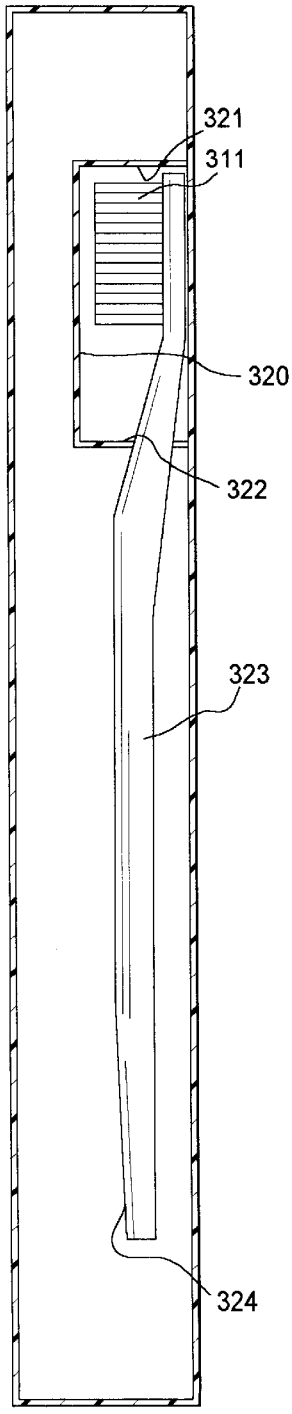
FIG. 3C is a view in side elevation of a second variation of the transport device according to FIG. 3A.

In the preferred embodiment of FIGS. 1A–1C, first cavity 114 is separated from a second cavity 116 by supporting wall 118. However, the geometry of specific brushes may or may not require a supporting wall. For example, if the handle geometry is such that recess 124 holds bristles 111 free from any contact, the supporting wall may be eliminated as shown in FIGS. 3A, 3B and 3C. Supporting wall 18 acts to delimit the first (114) and second (116) cavities, while providing support for the toothbrush 113 during its processing or travel through or between processing steps. Supporting wall 118 generally contacts or supports the neck 117 of a brush and provides vertical support, thereby maintaining the bristles in a non-contacting position with any portion of first cavity 114. Hence, first cavity 114 must be of sufficient size to ensure that the bristles of the brush are not in contact with any of its surfaces.

Figure 2A:
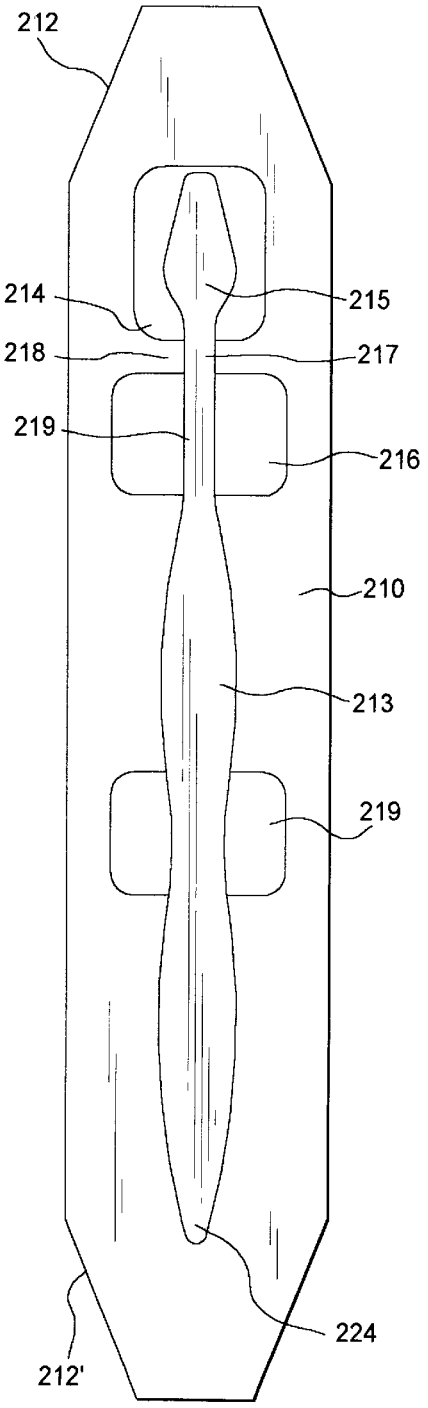
FIG. 2A is a top plan view of a second embodiment of a transport device according to the present invention.
Figure 2B:
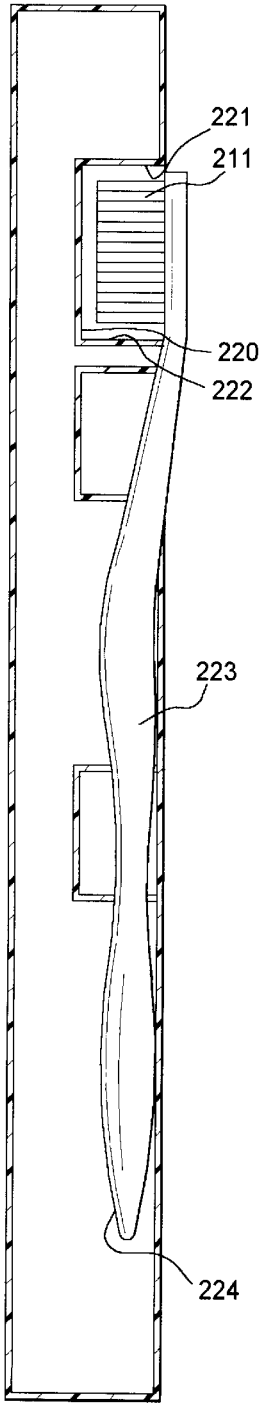
FIG. 2B is a view in side elevation of a first variation of the transport device according to FIG. 2A.
Figure 2C:
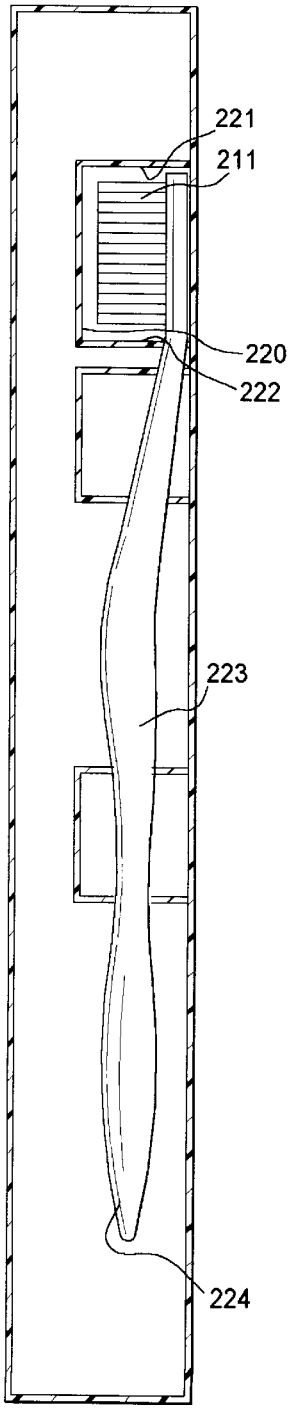
FIG. 2C is a view in side elevation of a second variation of the transport device according to FIG. 2A.

Second cavity 116 provides access to the brush neck lower portion 119 in order that a mechanical device can grab or pick the brush up and remove it from the transport device. It will be appreciated, however, that second cavity 116 may be placed anywhere along the length of the handle as best suited. Multiple cavities along the handle axis may be required to place brushes in or remove brushes from the transport devices, as are illustrated in FIGS. 2A–2C. Second cavity 116 is joined by a cavity in the general shape of the toothbrush to be transported. As shown in FIG. 1B, the brush 113 may be partially within device body 110 or as shown in FIG. 1C, the brush 113 is wholly within device body 110.

Body 110 generally protects the brush from wear, dings, dents, and the hard knocks found in a processing or manufacturing plant. Further, the brushes (which are unstable when on a conveyor alone) are maintained in fixed, predictable positions. The starting or stopping of a belt will not cause them to shift or tumble, and the brushes are stabilized.

FIGS. 1B and 1C are side views of the inventive device with a brush in place. Bristles 113 are now visible and do not contact bottom cavity wall 120, or side walls 121 or 122 of first cavity 114. The bristles thereby are protected from any damage. Brush handle 123 is set in lowered recess 124 which acts to stabilize the brush on or in body 110. The recess may be form fitting to the brush, or larger so that the brush is simply held in place by gravity.

FIGS. 2A to 2C represent a second embodiment of a transport device of this present invention. In this embodiment, there are three recesses areas, 214, 216, and 219. In FIG. 2B, the recesses are relatively shallow, and a portion of the brush extends above the plane of the top surface of the transport device 210. This embodiment is useful when further processing takes place in accordance with FIG. 4, to be discussed below. In FIG. 2C, the recesses are relatively deep, and no portion of the brush extends above the plane of the top surface of the transport device 210. This embodiment is useful when it is desired to stack the transport devices 210 for further processing in accordance with FIG. 5, to be discussed below.

FIGS. 3A to 3C represent a third embodiment of a transport device according to the present invention. In this embodiment, there is a single recessed area, 314. In FIG. 3B, the recess is relatively shallow, and a portion of the brush extends above the plane of the top surface of the transport device 310. This embodiment is useful when further processing takes place in accordance with FIG. 4, to be discussed below. In FIG. 3C, the recess is relatively deep, and no portion of the brush extends above the plane of the top surface of the transport device 310. This embodiment is useful when it is desired to stack the transport devices 310 for further processing in accordance with FIG. 5, to be discussed below.

Figure 4:
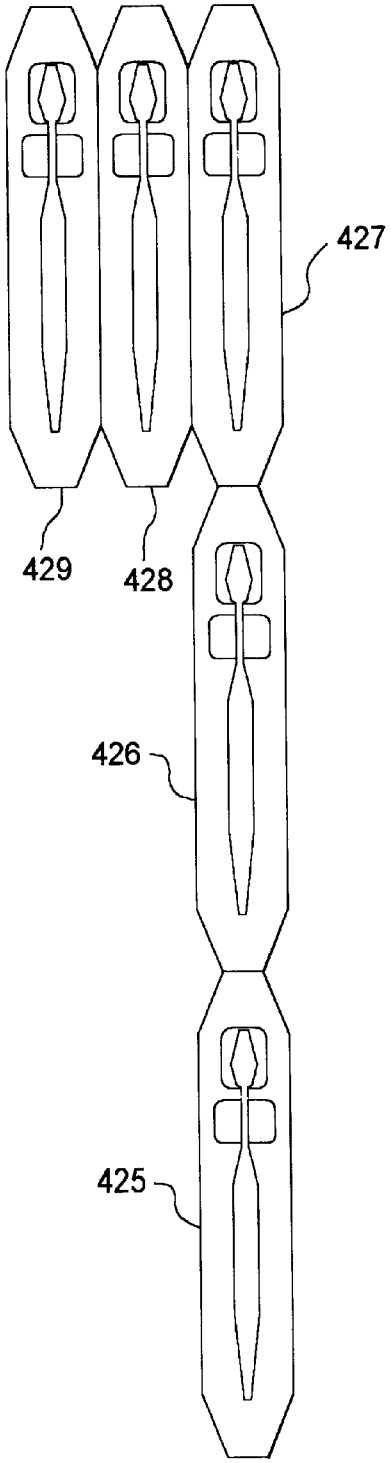
FIG. 4A is a top plan view of the inventive transport devices in line for further processing.

FIG. 4 represents a series of the bodies according to the invention (25–29). Bodies 427, 428, and 429 may be gravity fed onto a moving conveyor behind bodies 426 and 425, or a conveyor may bring bodies 425 and 426 to a gravity fed storage location. The bodies are, in either event, easily movable.

Figure 5:
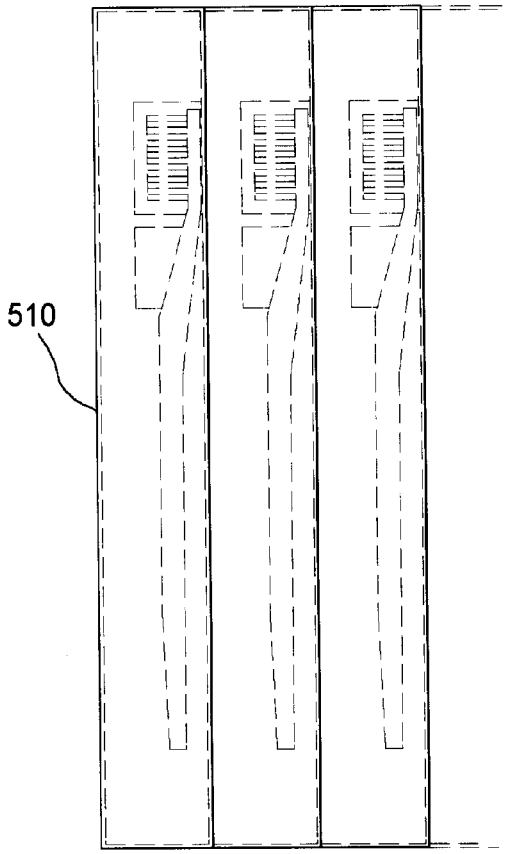
FIG. 5 is a top plan view of the inventive transport devices stacked for further processing.

FIG. 5 represents a series of the bodies according to the invention (527–529). Bodies 527, 528, and 529 are stackable and may be gravity fed onto a moving conveyor, or a conveyor may bring bodies 527–529 to a gravity fed storage location. The bodies are, in either event, easily stackable and movable.

Figure 6:
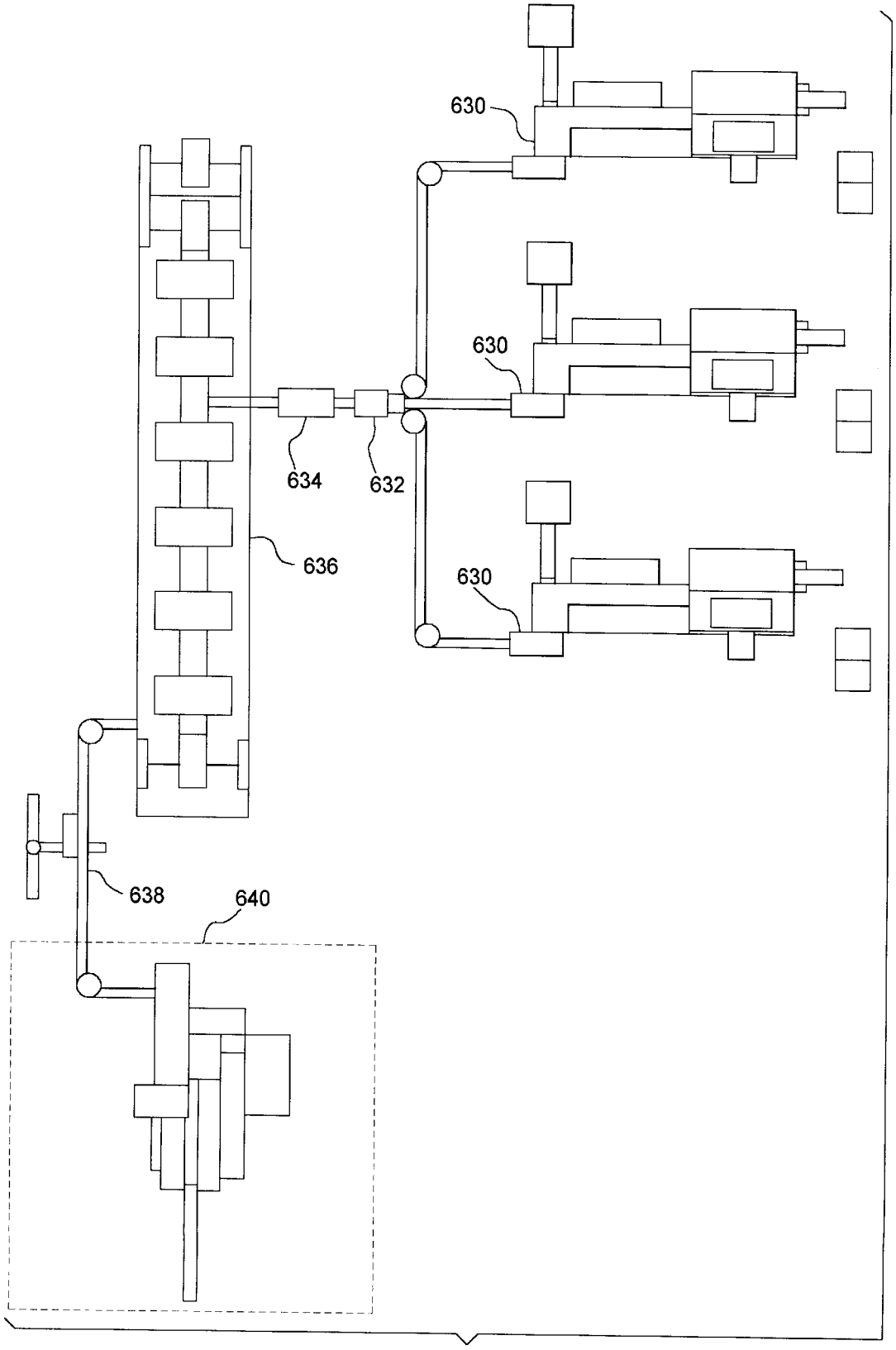
FIG. 6 represents a schematic diagram of a toothbrush assembly line in which the transport device of instant invention is useful.

FIG. 6 illustrates a schematic of an assembly line the efficiency of which the present invention will dramatically improve. The brushes are tufted in tufting machines 630, and the tufted brushes placed upon bodies according to the present invention. A plurality of machines may now be utilized, as the brushes are in bodies which make the functioning of a combiner 632 reliable and efficient. Several brushes may be fed into a single path of travel without tipping, rolling, or falling off the conveyor. The accumulator 634 will also allow a stockpile of brushes for processing procedure 636 (such as a sealing procedure). There, the brushes can be thermoformed, sealed, or otherwise processed as necessary, either while in the carrier or upon being removed.

In any event, the carrier is easily transferred through processing station 636, to labeling station 638 and to cartoning station 60. After the brush handle is removed, the body may then be re-sent via another route to the tufting station where the process may continue.

The bodies according to the present invention offer the ability to have several different operations running at the same time, thereby reducing processing bottlenecks by allowing easy recombination of the brushes while in the transporting bodies. Efficiency is therefore increased by this novel advance.

Having described the invention as above, I claim:

1. A device for facilitating the transport of a toothbrush during a manufacturing process, said toothbrush having a head portion, a neck portion extending from said head portion and a handle portion extending from said handle portion, said toothbrush having a plurality of bristles affixed to one surface of said head portion, said transport device comprising a solid body being formed with at least one recess, said recess having a generally toothbrush-shaped portion and terminating in at least one cavity suitable to hold at least the head portion of said toothbrush such that the bristles do not contact any interior surface of said cavity, wherein if only one cavity is present, said cavity is of sufficient size to permit a gripping mechanism to grasp a portion of said toothbrush to permit the insertion of said toothbrush into or the removal of said toothbrush from said transport device, and wherein if more than one cavity is present, said cavities are separated by a supporting wall.

2. A transport device as claimed in claim 1, wherein said solid body includes a second cavity, said second cavity being of sufficient size to permit a gripping mechanism to grasp a portion of said toothbrush to permit the insertion of said toothbrush into or the removal of said toothbrush from said transport device, and wherein said first cavity holds at least the head portion of said toothbrush such that the bristles do not contact any interior surface of said first cavity.

3. A transport device as claimed in claim 2, wherein said solid body includes a third cavity, said third cavity being of sufficient size to permit a gripping mechanism to grasp a portion of said toothbrush to permit the insertion of said toothbrush into or the removal of said toothbrush from said transport device.

4. A device as claimed in claim 3, wherein the solid body is a regular geometric shape.

5. A device as claimed in claim 4, wherein the regular geometric shape is a rectangle or square.

6. A device as claimed in claim 4, wherein the regular geometric shape is a polygon.

7. A device as claimed in claim 4, wherein the regular geometric shape is a rectangle with rounded corners.

8. A device as claimed in claim 4, wherein the regular geometric shape is a rectangle with angled corners.

9. A transport unit for use in automated brush processing, comprising, in combination, a brush having bristles, a head, neck, and handle, with a transport body having a solid body, and two walled cavities separated by a support wall, wherein a) the bristles are within the first cavity and are not in contact with any wall of the cavity, b) the neck of the brush rests on the support wall of the solid body, c) the second cavity is below at least one part of the brush other than the bristles, and d) the handle of the brush rests on the transport body, whereby a stable unit is formed for transport in the automated processing.

10. A transport unit as claimed in claim 9, wherein the transport body is formed with a third cavity which engages the handle of the brush.

11. A transport unit as claimed in claim 10, wherein the third cavity frictionally engages the handle of the brush.

12. A transport unit as claimed in claim 9, wherein the transport body is substantially rectangular shaped with tapered corners.

13. The transport unit of claim 9 wherein said recess is of such depth that said toothbrush is wholly contained therewithin.

14. The transport unit of claim 9 wherein said toothbrush containing transport bodies are transported between processing operations in stacked groups.

15. The transport unit of claim 9 wherein said recess is of such depth that said toothbrush is partially contained therewithin.

16. The transport unit of claim 9 wherein said toothbrush containing transport bodies are transported between processing operations in aligned groups.

17. A method for processing a toothbrush having a head portion to which a plurality of bristle tufts is attached in an automated processing facility, comprising the steps of a) providing at least one processing station;

b) providing a plurality of transport bodies, which transport bodies are associated with at least one brush, and which transport bodies include generally brush-shaped recesses having at least one cavity therein;

c) engaging said plurality of transport bodies with said at least one brush such that the bristle portion of said brush head is contained within said at least one cavity such that the bristles do not contact any interior surface of said cavity, wherein if only one cavity is present, said cavity is of sufficient size to permit a gripping mechanism to grasp a portion of said toothbrush to permit the insertion of said toothbrush into or the removal of said toothbrush from said transport device, and wherein if more than one cavity is present, said cavities are separated by a supporting wall;

d) transporting the combined brush and transport body to the at least one processing station, and e) conducting the at least one processing operation on the brush.

18. The method of claim 17 wherein said recess is of such depth that said toothbrush is wholly contained therewithin.

19. The method of claim 17 wherein said toothbrush containing transport bodies are transported between processing operations in stacked groups.

20. The method of claim 17 wherein said recess is of such depth that said toothbrush is partially contained therewithin.

21. The method of claim 17 wherein said toothbrush containing transport bodies are transported between processing operations in aligned groups.

* * * * *